United States Patent [19]

Seitz

[11] 4,354,142

[45] Oct. 12, 1982

[54] CIRCUIT ARRANGEMENT FOR THE PULSED ILLUMINATION OF A STROBOSCOPE RING

[75] Inventor: Alfred Seitz, Berlin, Fed. Rep. of Germany

[73] Assignee: U.S. Philips Corporation, New York, N.Y.

[21] Appl. No.: 170,353

[22] Filed: Jul. 21, 1980

[30] Foreign Application Priority Data

Jul. 21, 1980 [DE] Fed. Rep. of Germany ..... 2916623

[51] Int. Cl.[3] ..... H05B 37/00

[52] U.S. Cl. ..... 315/241 S; 315/32; 315/200 A; 340/662

[58] Field of Search ..... 315/32, 200 A, 241 S; 307/311, 351; 340/662

[56] References Cited

U.S. PATENT DOCUMENTS

| | | | |
|---|---|---|---|
| 1,799,993 | 4/1931 | Staege | 315/245 |
| 3,541,457 | 11/1970 | Leighty | 307/351 |
| 3,737,731 | 6/1973 | Zeewy | 315/200 A |
| 3,924,253 | 12/1975 | Marino | 315/200 A |
| 4,229,669 | 10/1980 | Smith | 307/311 |

*Primary Examiner*—Harold A. Dixon

*Attorney, Agent, or Firm*—Paul R. Miller

[57] ABSTRACT

A circuit arrangement for the pulsed illumination of a stroboscope ring of a record player is formed from a pulsating direct voltage by rectification, and the pulsating direct voltage is applied to a series connection of an ohmic resistor and a light emitting diode.

3 Claims, 2 Drawing Figures

CIRCUIT ARRANGEMENT FOR THE PULSED ILLUMINATION OF A STROBOSCOPE RING

Figure 1:
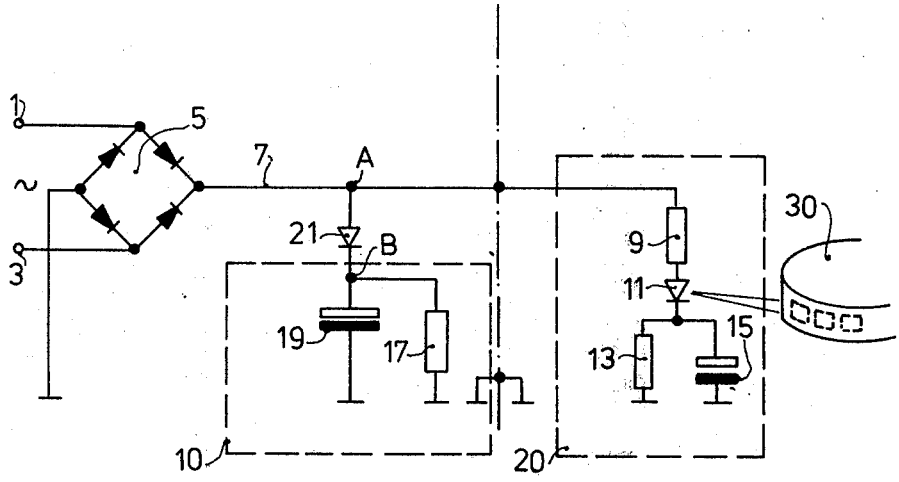

Circuit arrangement for the pulsed illumination of the stroboscope ring of a record player using a pulsating direct voltage formed by rectification.

From DE-PS 897 169 it is known to illuminate a stroboscope ring by brief sharp pulses. A glow-discharge lamp is then ignited by means of a tube circuit. The circuit is comparatively complex, because apart from a driver tube an additional transformer winding and further drive elements are required.

From US-PS 1,799,993 a circuit arrangement is known in which the driver tube has been dispensed with. By an ohmic resistor a charging capacitor is charged by a transformer for so long within a period that the ignition voltage of a glow-discharge lamp, which is connected in parallel across the capacitor, is reached. The capacitor then dischargers by the glow-discharge lamp with a pulse-shaped current. Apart from the use of an intricate transformer winding, it is a drawback that a high operating voltage is required.

It is the object of the present invention to provide a circuit arrangement of the type mentioned in the preamble, which can be operated with a low voltage and which can be connected to a rectifier circuit which is necessary for operation.

According to the invention the problem is solved in that the pulsating direct voltage is applied to a series connection of an ohmic resistor and a light-emitting diode.

This circuit arrangement, which can be operated with a low voltage, is very simple, substantially voltage-independent and reliable.

In accordance with a further embodiment of the invention a parallel-connection of a further ohmic resistor and a capacitor is connected in series with the series connection. This enables the period in which a peak current flows to be kept comparatively small. The length of the current flow period then depends on the dimensioning of the two resistors and the capacitor, allowance being made for the permissible limit values of the light-emitting diode.

The invention will be described in more detail by means of an example. In the drawing:

FIG. 1 represents a circuit diagram of the circuit arrangement, and

Figures 2A, 2B, 2C:
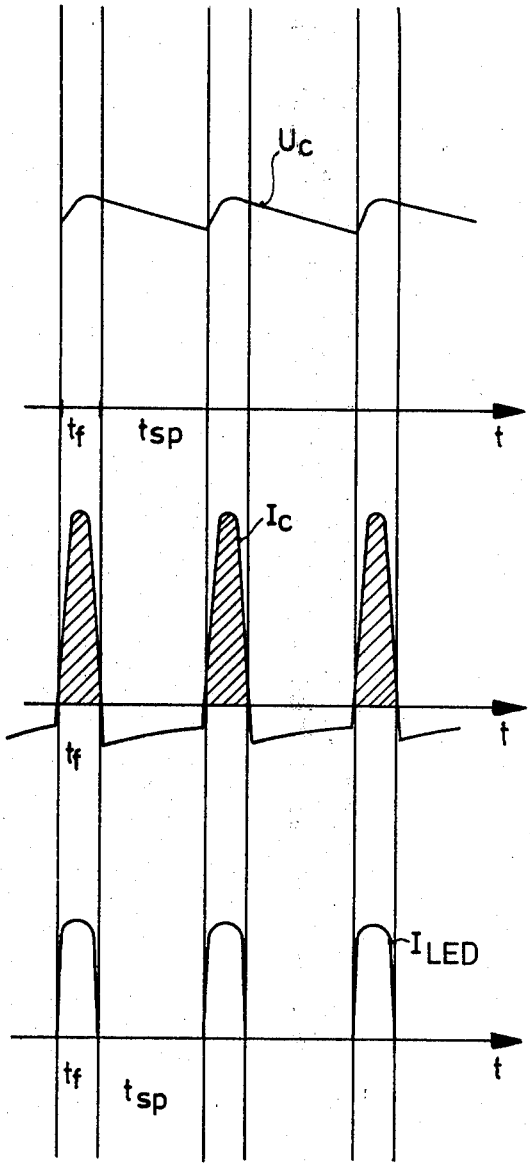

FIGS. 2*a*, 2*b* and 2*c* provide the current and voltage variation across the capacitor associated with the light-emitting diode as well as the variation of the current through the light-emitting diode as a function of time.

A rectifier bridge 5 is connected to the terminals 1, 3 of an alternating voltage source. In the case of a 50 Hz current source this rectifier bridge supplies a direct voltage which pulsates with 100 Hz. Of course, this pulsating direct voltage may also be generated in any other known manner, depending on the frequency required by the load or the indicator device connected to it. By a line 7 the pulsating direct voltage is applied to a series connection comprising an ohmic resistor 9, a light-emitting diode 11 and a parallel connection of a second ohmic resistor 13 and a capacitor 15.

In the steady-state condition during the period that a current flows in the light-emitting diode 11 the capacitor 15 is recharged to an extent equal to the voltage loss across the resistor 13 in the period that no current flows in the light-emitting diode (FIG. 2*a*). The current of the capacitor 15 is represented in FIG. 2*b*. The recharging time is designated $t_f$ in FIGS. 2*a–c*. The recharging time is followed by a time interval $t_{sp}$ in which no current flows in the light-emitting diode 11. By suitably dimensioning the resistors 9 and 13 as well as the capacitor 15 it is ensured that the time of periodic current flow is minimized and the current value $I_{LED}$ is as high as possible. Obviously the limit values of the light-emitting diodes 11 should be taken into account (FIG. 2*c*).

If this circuit arrangement is used the current through the light-emitting diode produces periodic light flashes of short duration and high intensity. If a stroboscope ring 30 is illuminated by these short light flashes, a sharp stroboscope image becomes visible.

In an electric record player provided with a stroboscope, which may be regarded as the load 20, a smoothed direct voltage is required in addition to the pulsating direct voltage. The smoothed direct voltage is used for energizing the motor and for example a control and/or amplifier circuit of a record player and may be regarded as a second load 10. In the drawing the components of the second load 10 are represented by the load 17. The use of the circuit arrangement with the two loads depends on the power distribution between the two loads and on the types of diodes which are suitable.

In the line 7 the pulsating direct voltage should not be smoothed in view of the pulsed operation of the light-emitting diode 11. Therefore, the smoothing action of smoothing capacitor 19 should not influence the line 7 on point A, to which the second load is connected. In order to guarantee this, the voltage which is smoothed by the capacitor 19 is isolated from the pulsating direct voltage on point A in the line 7 by an additional diode 21. The voltage variation across the capacitors 15 and 19 is then substantially the same.

What is claimed is:

1. A circuit arrangement for pulsed illumination of a stroboscopic ring used for a record player comprising an alternating voltage source, means connected to said alternating voltage source for providing a pulsating direct voltage, a series circuit connected to said means and including a first resistor, a light emitting diode, and a parallel circuit of a second resistor and a capacitor, a stroboscope ring receiving periodic light pulses from said light emitting diode to produce stroboscopic images, and a smoothing circuit connected in parallel with said series circuit, said smoothing circuit including a diode for isolating said smoothing circuit from said pulsating direct voltage and a second parallel circuit of a load and second capacitor.

2. A circuit arrangement according to claim 1, wherein said means includes a rectifier bridge.

3. A circuit arrangement according to claim 1, wherein said load may be a motor, a control or an amplifier circuit of a record player.

* * * * *

UNITED STATES PATENT AND TRADEMARK OFFICE

CERTIFICATE OF CORRECTION

PATENT NO. : 4,354,142

DATED : October 12, 1982

INVENTOR(S) : ALFRED SEITZ

It is certified that error appears in the above—identified patent and that said Letters Patent is hereby corrected as shown below:

Col. 1, Line 21, "dischargers" to --discharges--.

Signed and Sealed this

*Eleventh* Day of *January 1983*

[SEAL]

*Attest:*

GERALD J MOSSINGHOFF

*Attesting Officer*

*Commissioner of Patents and Trademarks*